US007258335B2

(12) United States Patent
Johnson et al.

(10) Patent No.: US 7,258,335 B2
(45) Date of Patent: Aug. 21, 2007

(54) ELIMINATING DRAG OF MEDIA SENSOR IN PRINTER MEDIA TRANSPORT

(75) Inventors: Kevin Matthew Johnson, Georgetown, KY (US); Michael William Lawrence, Lexington, KY (US); Bryan Christopher Scharf, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 420 days.

(21) Appl. No.: 10/925,281

(22) Filed: Aug. 24, 2004

(65) Prior Publication Data

US 2006/0044377 A1 Mar. 2, 2006

(51) Int. Cl.
*B65H 5/00* (2006.01)

(52) U.S. Cl. ..... 271/10.01; 271/10.09; 271/117; 271/273

(58) Field of Classification Search ..... 271/109, 271/113, 117, 118, 265.01, 273, 274, 10.01, 271/10.05, 10.09, 10.11
See application file for complete search history.

(56) References Cited

U.S. PATENT DOCUMENTS 5,531,435 A * 7/1996 Momose ..... 271/258.03
6,059,279 A * 5/2000 Wenthe, Jr. ..... 271/10.13
6,375,183 B1 * 4/2002 Inoue et al. ..... 271/10.11
6,599,041 B1 7/2003 Ahne et al.
6,769,680 B2 * 8/2004 Kojima et al. ..... 271/117
6,974,127 B2 * 12/2005 Kang ..... 271/10.11
7,093,830 B2 * 8/2006 Kang ..... 271/118
7,121,546 B2 * 10/2006 Johnson et al. ..... 271/273
2005/0275150 A1 * 12/2005 Cook et al. ..... 271/109
2006/0071422 A1 * 4/2006 Klein et al. ..... 271/274

* cited by examiner

*Primary Examiner*—David H. Bollinger
*Assistant Examiner*—Michael C McCullough
(74) *Attorney, Agent, or Firm*—King & Schickli, PLLC

(57) ABSTRACT

Drag from media sensor (80) of a printer is eliminated by it being pivoted through a slip connection off of pivoted media feed system (19) to briefly contact papers. The pivoted media feed is then moved in reverse a limited amount at which a rotatably biased member (94) moves ledge (94*a*) of the member to face abutment surface (92*a*) of the media sensor. Media feed system 19 is then moved back to drive media while the media sensor is blocked from movement and the slip connection simply slips. After the media is fed, the media feed system is moved away a longer amount while the media sensor is blocked against for the same movement by an abutment (110) in the printer. The media feed system after the longer movement moves a lever (94*f*) of the biased member and rotates the ledge to free the media sensor to again move to the media.

4 Claims, 13 Drawing Sheets

ELIMINATING DRAG OF MEDIA SENSOR IN PRINTER MEDIA TRANSPORT

TECHNICAL FIELD

This invention relates to imaging devices that feed media over a paper path and sense the media in the paper path with a sensor.

BACKGROUND OF THE INVENTION

Media sensors are known which reliably determine the difference between coated, plan, photo and transparency media types. These sensors contact the media with significant force and have been located in the media tray from which media is fed into a media feed path to reach an imaging station.

However, the media sensor pressing onto the surface of paper or other media creates a small amount of drag which can affect paper pick and feed adversely on some types of media, such as small media. Marks on the surface of photo paper made by drag on the media sensor may also occur.

Where the media sensor is located in the media path between the tray and the imaging station the problem of skew of small media becomes very significant. Accordingly, eliminating drag from contact with the media sensor is very desirable.

DISCLOSURE OF THE INVENTION

This invention employs a mechanical system having a pivoted feed system located at an intermediate location proximate to the feed path. (In an embodiment, a pivoting autocompensating system which comprises one or more feed rollers on a swing arm pivoted around a gear train which drives the feed roller. Autocompensating systems are cost-effective and may be moved toward the media for feeding and off the media by reversing the torque to the gear train.)

The media sensor is pivotably mounted to move through a slip connection from the pivoted feed system. Movement of the media sensor away from the media in the feed path is limited by an abutment of the imaging device. Movement of the pivoted feed system away from media in the feed path can be longer, thereby moving the pivoted feed system further while the media sensor slips at the slip connection.

When media first reaches the location of the media sensor, the pivoted feed system is further away from the paper path than the media sensor and the media sensor is free to move forward. Movement of the pivoted feed system moves the media sensor to the media through the slip connection. The sensing can take very little time. The pivoted feed system is then moved a limited amount away from the media.

A resiliently mounted latching member having a ledge is mounted on the frame of the imaging device. An abutment surface on the media sensor faces the ledge when the media sensor is moved a limited amount away from the media. After the limited movement away from the media, the pivoted feed system is moved forward to drive media while the sensing member is latched by contact between the abutment surface and the ledge from moving forward and the slip connection slips.

After the media is moved the pivoted feed system is moved away from the media feed location until it is past the limited movement location, were it encounters an arm of the latching member, which moves the ledge from facing the abutment surface of the media sensor. This frees the media sensor and permits the foregoing cycle to be repeated from the next media fed.

BRIEF DESCRIPTION OF THE DRAWINGS

The details of this invention will be described in connection with the accompanying drawings, in which.

DESCRIPTION OF THE PREFERRED EMBODIMENTS

Figure 1:
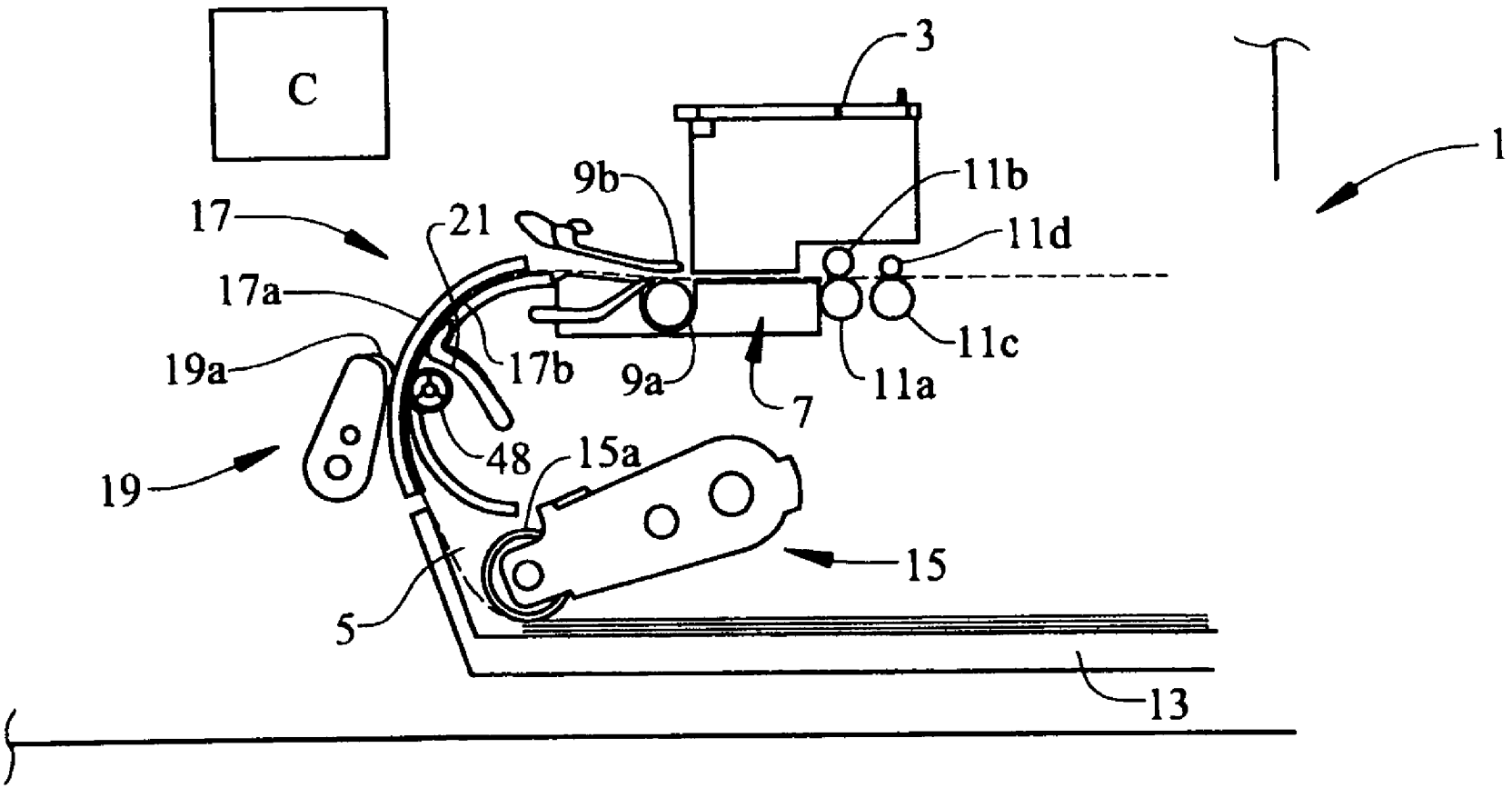
FIG. 1 is a printer and is illustrative of a long, C-shaped path between a paper tray and the imaging printhead.

FIG. 1 is illustrative of a printer 1 with specific elements pertinent to this invention. Printer 1 may be a standard inkjet printer in most respects. As such it has a bottle printhead 3 which jets dots of ink through nozzles not shown, which are located above a sheet 5 of paper or other media at a imaging station 7

Imaging station 7 is located past nip rollers 9*a*, 9*b* which grasp paper 5 in the nip of rollers 9*a*, 9*b* and move it under printhead 3. Nip rollers 9*a*, 9*b* are stopped normally several times to permit printhead 3 to partially image sheet 5 by moving across sheet 5 (in and out of the view of FIG. 1) while expelling dots in the desired pattern. In a draft mode the number of such intermittent stops may be only two, while in a quality mode that number may be five or more.

Nip rollers 9*a*, 9*b* push paper through the imaging station 7 where they enter exits rollers 11*a*, 11*b*, 11*c*, and 11*d*. Although rollers are by far the most common mechanism to transport the imaged sheet 5 out of the printer 1 to the user of the printer 1, virtually any grasping device can be used, such as a belt and pressing device or pneumatic suction device.

The printer of FIG. 1 has a paper tray 13 located on the bottom Tray 13 constitutes a bin in which a stack of paper or other media sheets 5 are held to be imaged. Having tray 13 located on the bottom of printer 1 permits a large stack of sheets 5 to be in the printer 1. This spaces the tray 13 from the print stations 7, the distance from pick roller 15*a* of tray 13 to nip rollers 9*a*, 9*b* being longer than the length of some media sheets 5 to be printed. Pick roller 15*a* is a part of an autocompensating swing mounted system 15.

A C-shaped paper guide 17 is made up of rear guide surface 17*a* and spaced, generally parallel, front guide surface 17*b*. Both surfaces have spaced ridges (shown for surface 17*b* as 17*bb* in FIG. 2), as is common. Guide 17 directs a sheet 5 to nip rollers 9*a*, 9*b*. Intermediate in guide 17 is drive roller 19*a*, which is a part of an autocompensating swing-mounted system 19. Sensor arm 21 is moved by a sheet 5 to detect the sheet 5 at system 19.

Pick roller 15*a* at tray 13 and drive roller 19*a* combine to move sheets 5 from tray 13 to nip rollers 9*a*, 9*b*. Drive roller 19*a* is effective to move short media into rollers 9*a*, 9*b*, when pick roller 15*a* is no longer in contact with the sheet 5.

Operational control is by electronic data processing apparatus, shown as element C in FIG. 1. Such control is now entirely standard. A standard microprocessor may be employed, although an Application Specific Integrated Circuit (commonly known as an ASIC) is also employed, which is essentially a special purpose computer, the purpose being to control all actions and timing of printer 1. Electronic control is so efficient and versatile that mechanical control by cams and relays and the like is virtually unknown in imaging. However, such control is not inconsistent with this invention.

Figure 2:
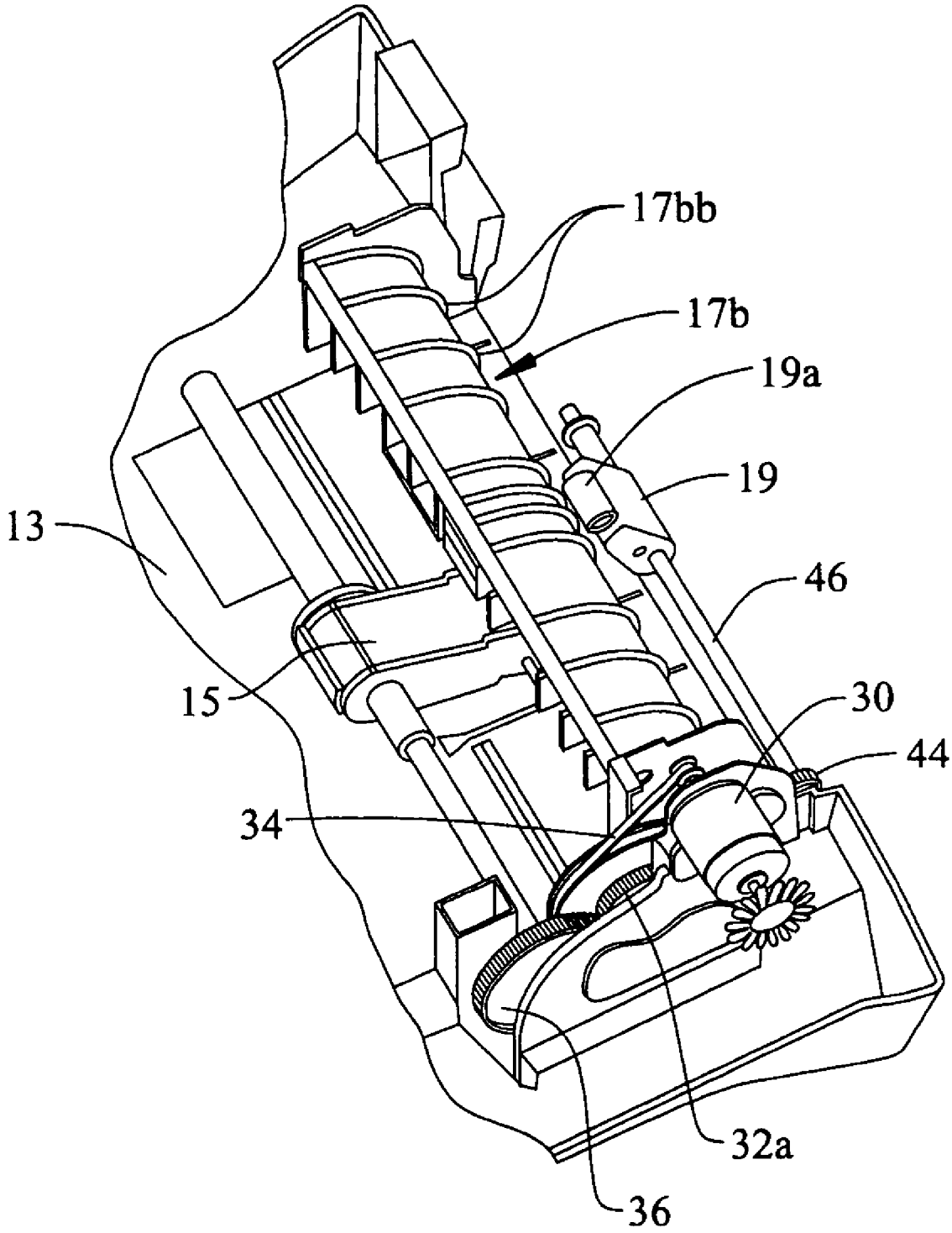
FIG. 2 is a partial, somewhat more detailed, perspective view downward on the tray and the front guide.
Figure 3:
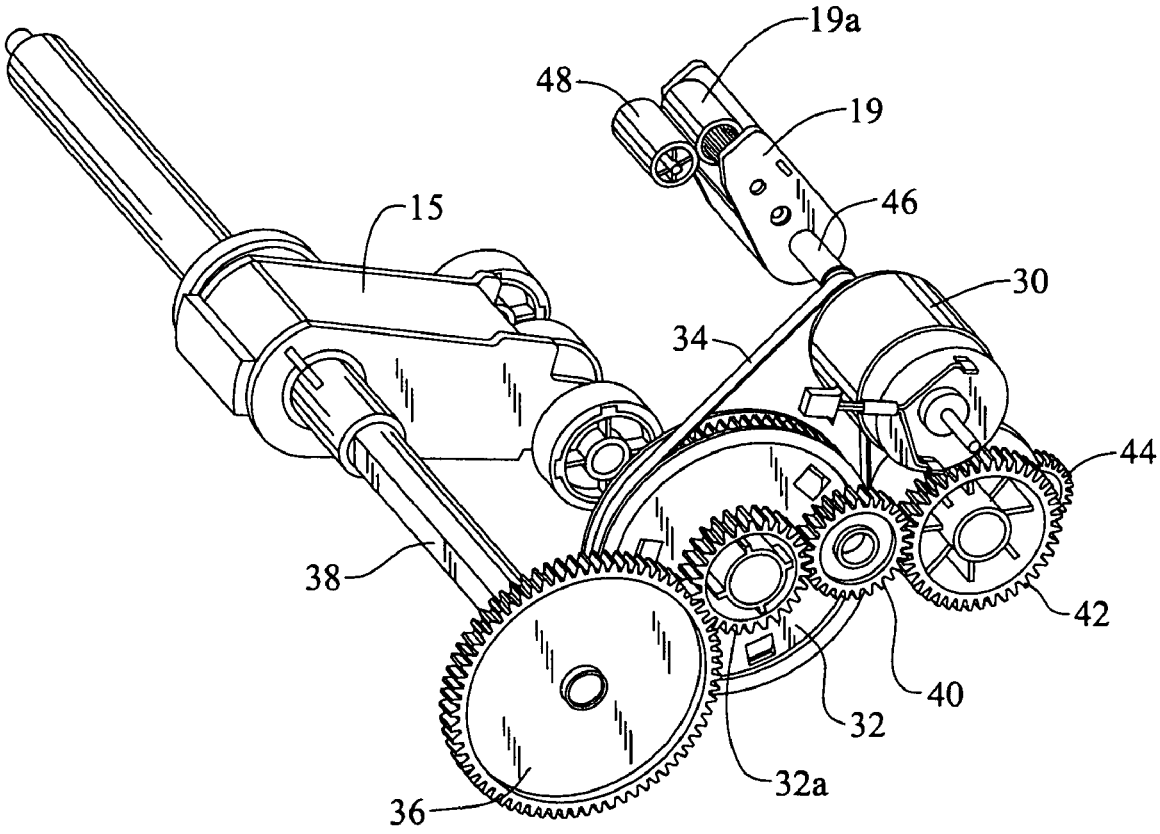
FIG. 3 is a view from the same side as the view of FIG. 2 of the motor and gear train to the autocompensating systems.
Figure 4:
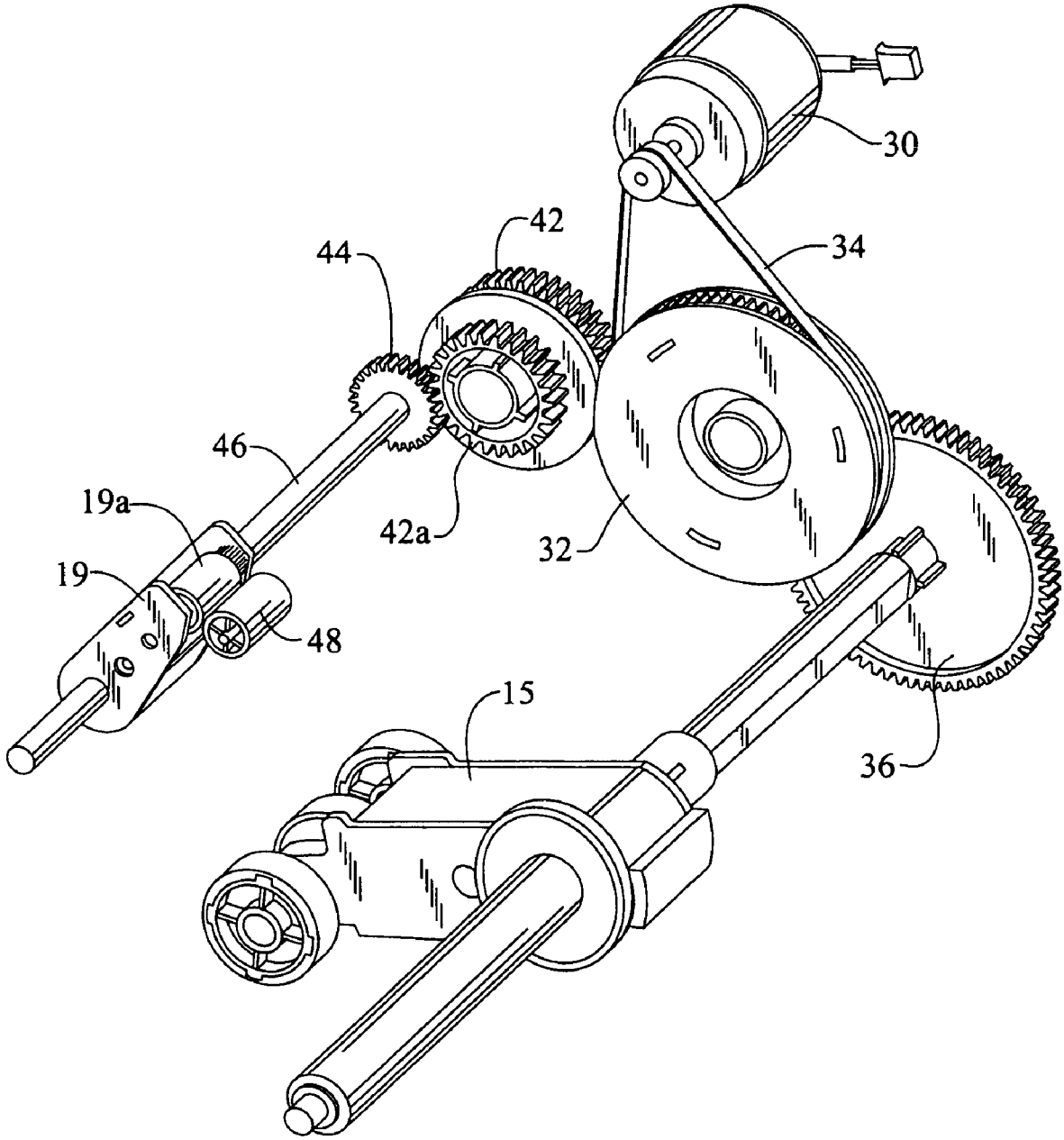
FIG. 4 is a view from the side opposite the view of FIG. 2 of motor and gear trains to the autocompensating systems.

Movement of parts in the printer is by one motor 30, shown in FIGS. 2, 3 and 4. With respect to FIG. 3 motor 30 is seen to drive a large gear 32 through a pulley 34. Gear 32 has integral with it a central, smaller gear 32*a*. The gear 32 is meshed with large gear 36, which is integral with shaft 38 to provide torque to autocompensating system 15.

Similarly, gear 32*a* meshes with idler gear 40 which meshes with a somewhat larger gear 42. Gear 42 has integral with it a central, smaller gear 42*a* (best seen in FIG. 4). Gear 42*a* is meshed with gear 44, which is integral with splined shaft 46 to provide torque to autocompensating system 19.

As is evident from the gears trains, rotation of motor 30 counterclockwise as viewed in FIG. 3 applies a downward torque (as discussed below) to autocompensating system 15 and an upward torque (as discussed below) to autocompensating system 19. Rotation of motor 30 clockwise reverses the direction of torque to both system 15 and system 19.

FIGS. 3 and 4 also illustrate a roller 48, which is mounted to roll free, which drive roller 19*a* contacts when driving should no media sheet 5 be under roller 19*a*, which avoids a high downward torque being generated. With respect to roller 15*a* in the tray 13, no comparable apparatus to roller 48 is used as the high torque can be used to signal absence of paper and therefore to terminate drive to autocompensating system 15.

Figure 5:
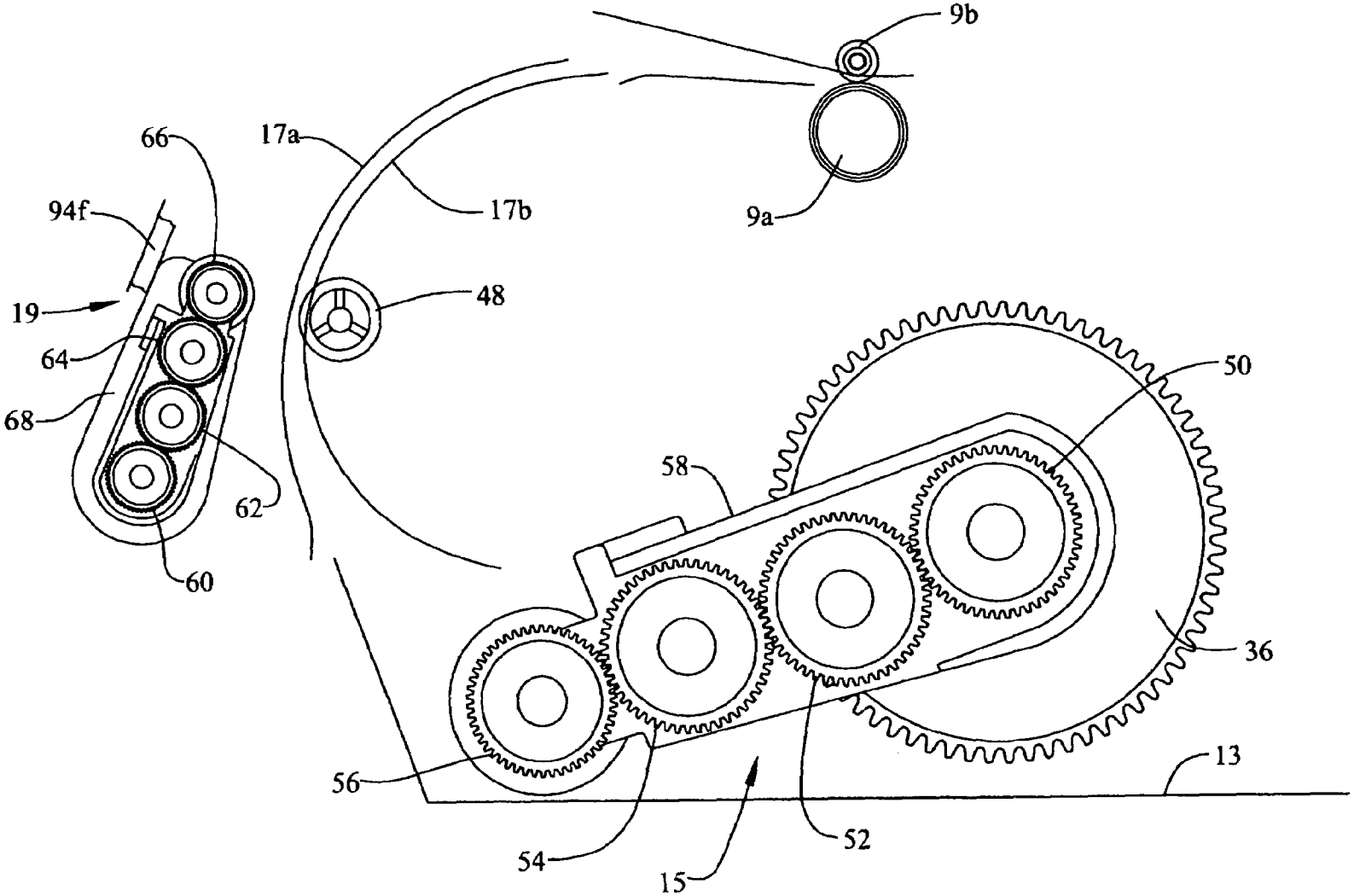
FIG. 5 illustrates the autocompensating systems in some detail and the drive path between tray and nip roller preceding the imaging station.

With reference to FIG. 5, autocompensating system 15 is seen to have four meshed gears 50, 52, 54 and 56 each meshed to the next gear in a linear train and supported within a bracket 58. Gear 56 is integral with drive roller 15*a* so that it moves both by pivoting (when gear 56 pivots) and by rotation (when gear 56 rotates). Gear 50 on the opposite end of the train of gears 50, 52, 54, and 56 is rotated by shaft 38 (FIGS. 2, 3 and 4). Similarly for autocompensating system 19 gears 60, 62, 64 and 66 are each meshed to the next gear in a linear train and supported within a bracket 68. Gear 66 is integral with drive roller 19*a* so that it moves both by pivoting (when gear 66 pivots) and by rotation (when gear 66 rotates).

Assuming counterclockwise torque to gear 50 and clockwise torque to gear 60, so long as gear 56 of system 15 or gear 66 of system 19 is not rotating, the torque pivots bracket 58 or bracket 68 respectively and the force against a sheet 5 of drive roller 15*a* and 19*a* increases toward the maximum pivoting force which can be applied by motor 30. This force is immediately relieved when gear 56 rotates in the case of system 15 and when gear 66 rotates in the case of system 19. Such rotation occurs when a sheet 5 is being moved, and it is the increase in pivot force against the sheet until it is moved which constitutes autocompensating in the systems.

Opposite or no rotation from the feeding rotation of gears 50 and 60 relieve pivoting torque because the direction of pivot is away from the feeding position and therefore the gears 56 and 66 respectively are free to rotate. To prevent such rotation with respect to system 15, gear 50 is driven through a one-way clutch, (not shown), which may be a conventional ball-and-unsymmetrical-notch clutch or other clutch.

Figure 6:
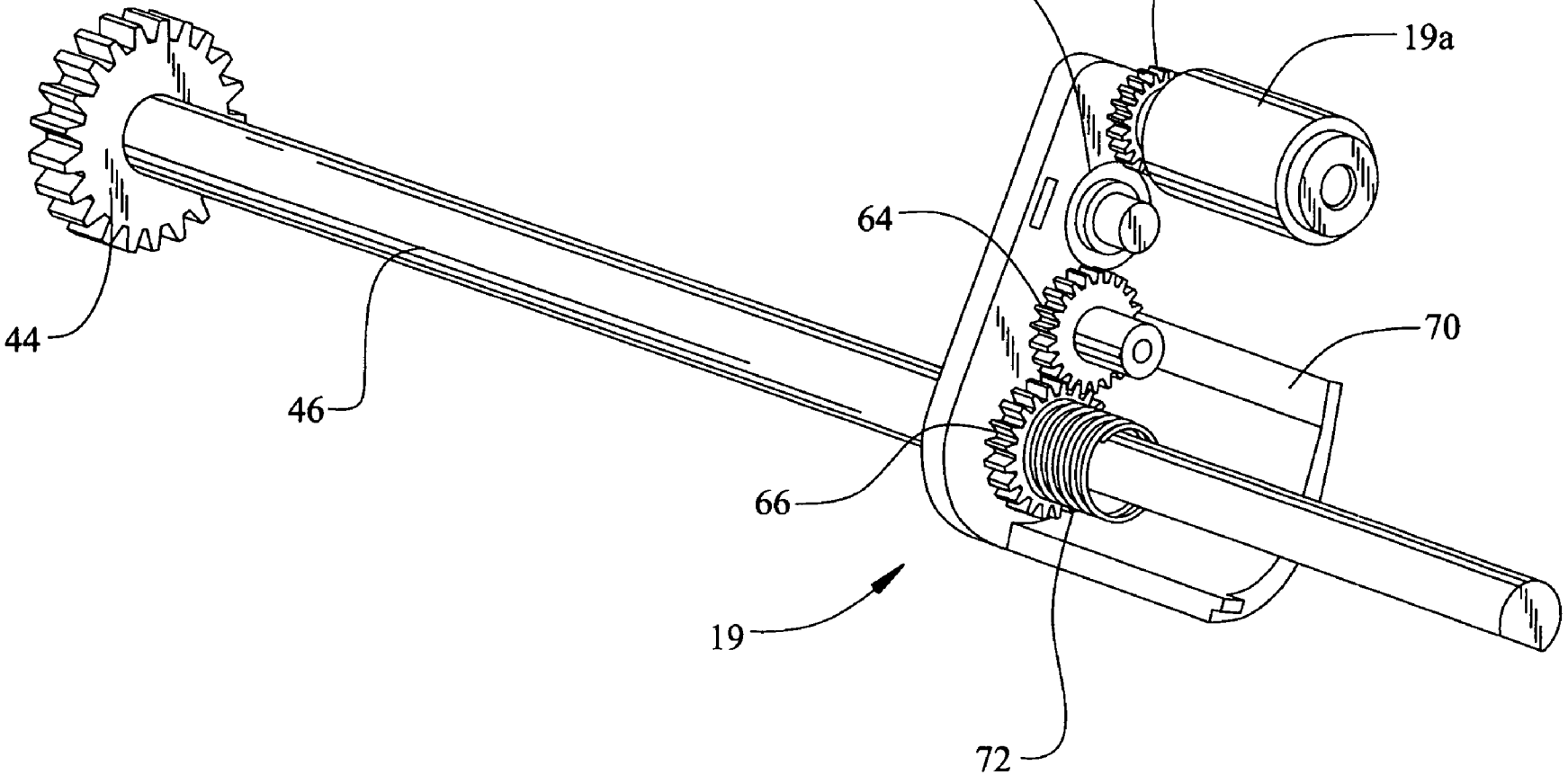
FIG. 6 is a perspective view of selected elements to explain the slip drive.

FIG. 5 shows autocompensating system 19 positively moved away from the guide 17. This occurs when gear 60 is driven in the direction opposite to sheet feed. To achieve that, an added mechanism is applied to the autocompensating system 19, which is illustrated in FIG. 6 and FIG. 7.

This mechanism is a slip drive. As shown in FIG. 6, within the housing 70 of autocompensating system 19 is a coil spring 72 mounted on drive shaft 46 and having one side in contact with the face of gear 66.

Figure 7:
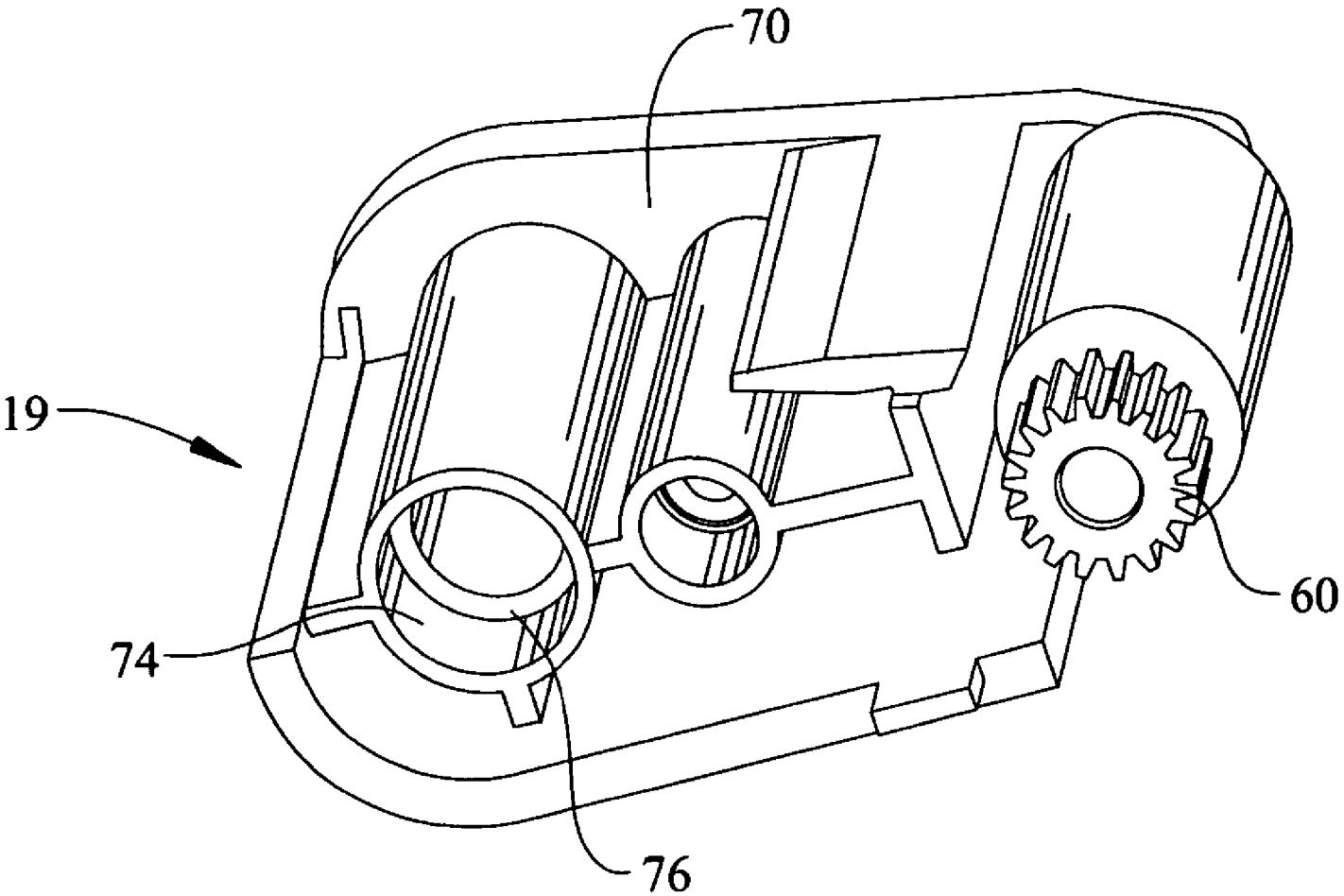
FIG. 7 is a perspective view of selected elements from the side opposite to that of FIG. 6 to explain the slip drive.

As shown in FIG. 7, housing 70 has a cylindrical well 74 with bottom face 76 which receives the side of spring 72 (FIG. 6) opposite to that which faces gear 66. The dimensions of well 74 are such that spring 72 is compressed.

With spring 72 compressed, the turning of gear 66 turns spring 72 and the turning of spring 72 tends to rotate the entire housing 70, since well 74 is integral with housing 70. However, when further rotation is blocked, spring 72 simply slips.

When gear 66 is rotated in the reverse feeding direction, system 19 is moved away from the drive path of guide 17 as shown in FIG. 5, where it is stopped by being blocked by lever 94*f* (described below) pushed against the frame of printer 1.

When gear 66 is rotated in the feeding direction, spring 72 adds somewhat to the downward force while slipping.

In basic operation, under control of controller C, motor 30 is driven to feed a sheet 5 from tray 13 by rotating autocompensating system 15 downward. Autocompensating system 19 is necessarily driven by the slip drive to move away from the paper feed direction. Accordingly, when a sheet 5 is being moved by system 15, system 19 is moved completely out of guide path 17, as shown in FIG. 5.

Figure 8:
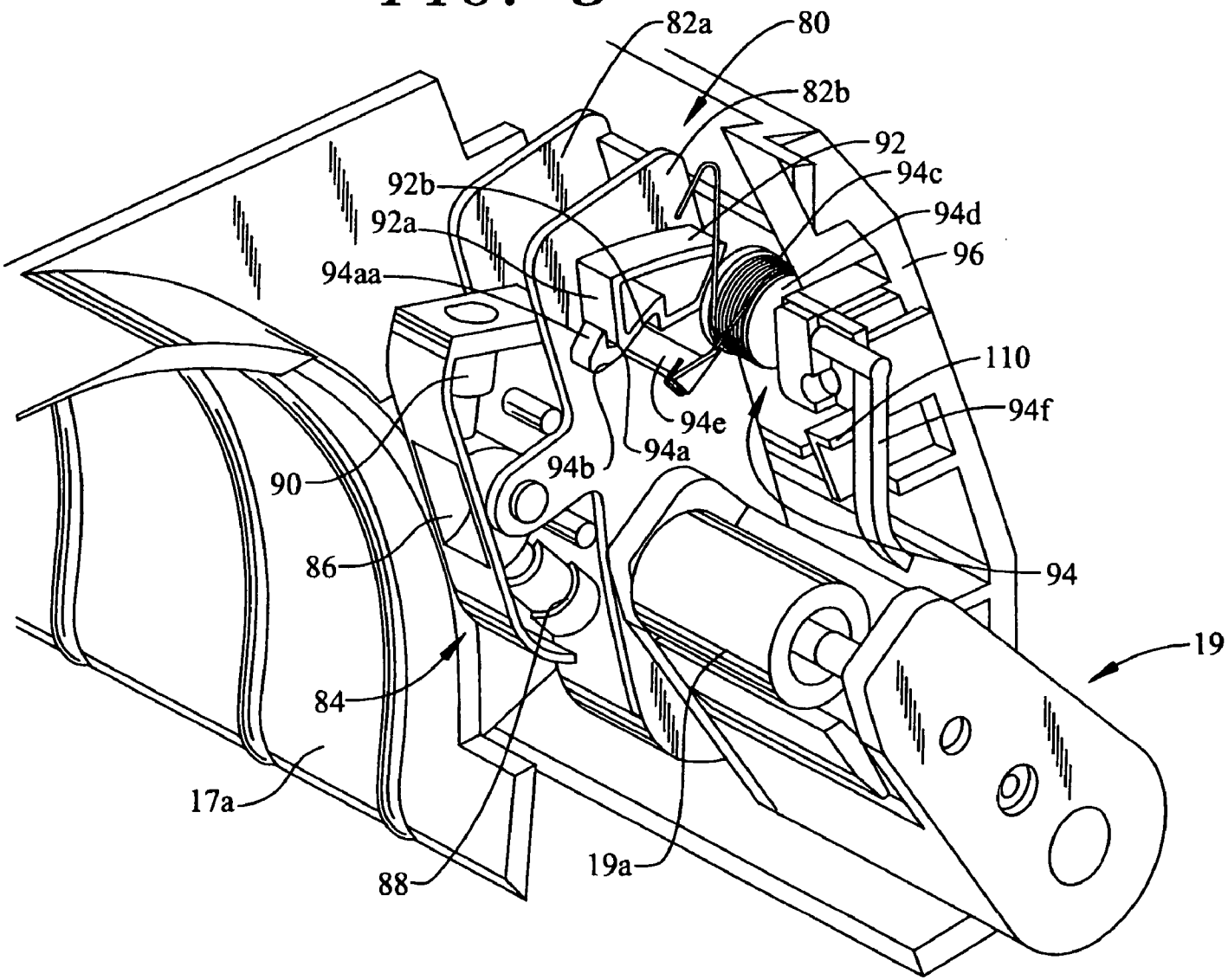
FIG. 8 is a perspective view of the media sensor and the pivoted drive mechanism.

As shown in FIG. 8 in accordance with this invention, media sensor 80 is positioned in the feed path of guide 17 proximate to autocompensating system 19. Media sensor 80 has supporting side brackets 82*a*, 82*b*, which support optical device assembly 84, having a viewing window 86. The details of such a sensor need not be new with this invention. A light sensing device and a light source device are suggested as elements 88 and 90 in FIG. 8.

Side bracket 82*b* has integral with it an extending structure 92 having a generally vertical abutment surface 92*a*. FIG. 8 shows the abutment surface 92*a* in latched engagement with ledge 94*a*, which is integral with rotatable assembly 94.

Rotatable assembly 94 is mounted to the frame of printer 1, more specifically to a back door 96. (Door 96 may or may not be removable for jam clearance or general maintenance.) Rotatable assembly 94 has an arm 94*b* which has at is end ledge 94*a*. Ledge 94*a* has a front camming surface 94*aa*. Which will cam against lower camming surface 92*b* of extending structure 92.

Rotatable assembly 94 has a coil spring 94*c* which is in pressure contact with a drum 94*d* and is mounted to the frame of printer 1 (details not shown), so that it provides a resilient biasing force upward (to move ledge 94*a* in front of abutment surface 92*a*). One end of spring 94*c* is under extension 94*e* from arm 94*b* to provide the resilient, upward force. Rotatable assembly 94 further has lever 94*f* positioned to be contacted by autocompensating system 19 when it moves to a long position away from media guide 17.

Figure 9:
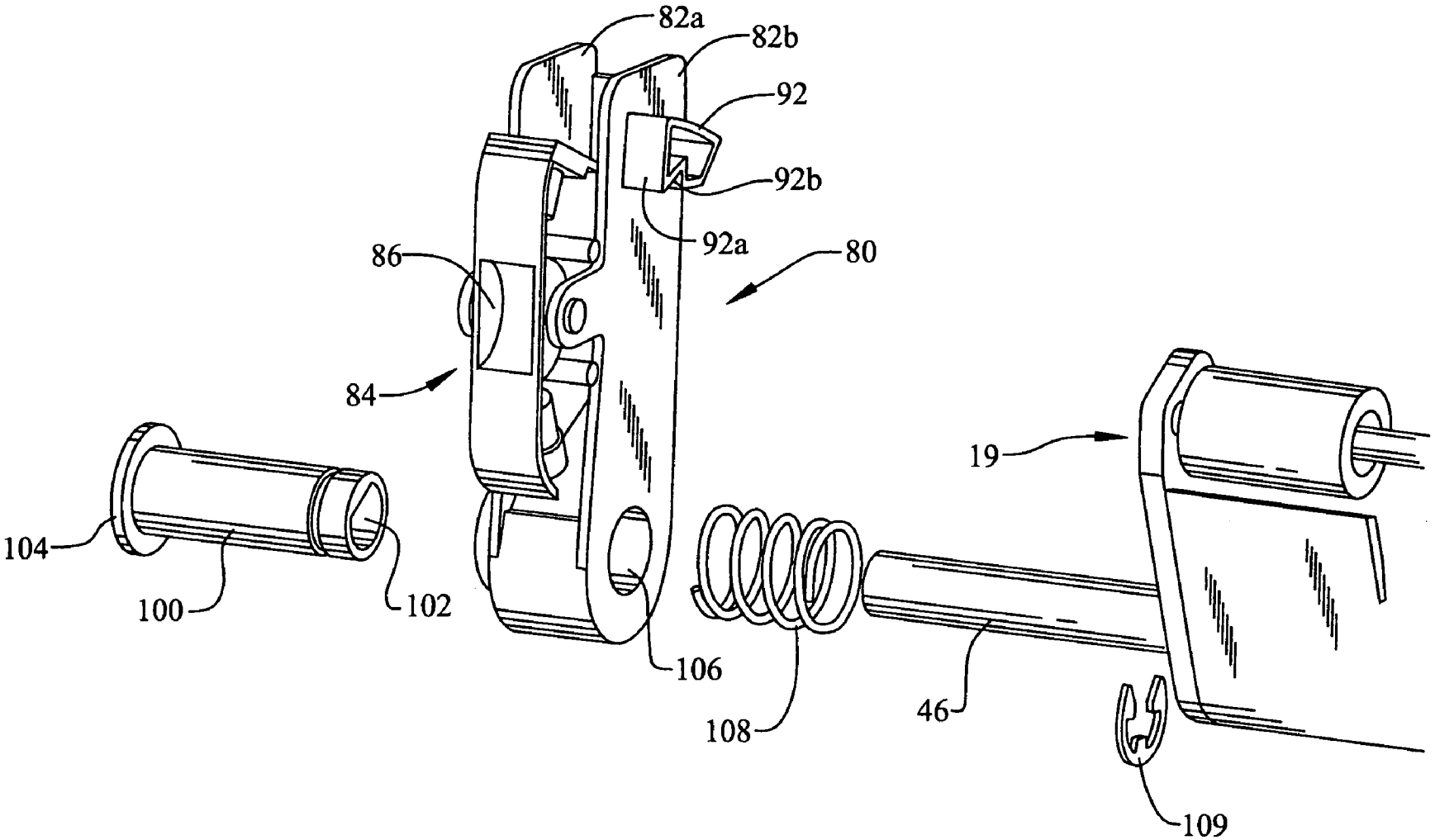
FIG. 9 is an exploded, somewhat different perspective view from FIG. 8 illustrating the slip connection.

FIG. 9 is an expanded view of selected elements from a somewhat different perspective from that of FIG. 8 to illustrate the slip connection between autocompensating system 19 and media sensor 80. Media sensor 80 receives an extended bushing 100 having a central opening with a flat 102 and an integral, outer flange 104. Bushing 100 fits in a matching channel 106 which connects brackets 82*a* and 82*b*. A coil spring 108 fits around bushing 100 and, in the actual assembly, is held tight against bracket 82*b* by C clip 109 held, as is standard, by in a channel in bushing 100. The flat of bushing 100 mates with the flat of shaft 46, so bushing 100 turns with shaft 46. However, the driving force transmitted to media sensor is essentially that of the face of flange 104 resiliently biased by spring 108 against the side of bracket 82*a*. Accordingly, this drive will simply slip when movement of media sensor 80 is blocked.

Figure 10:
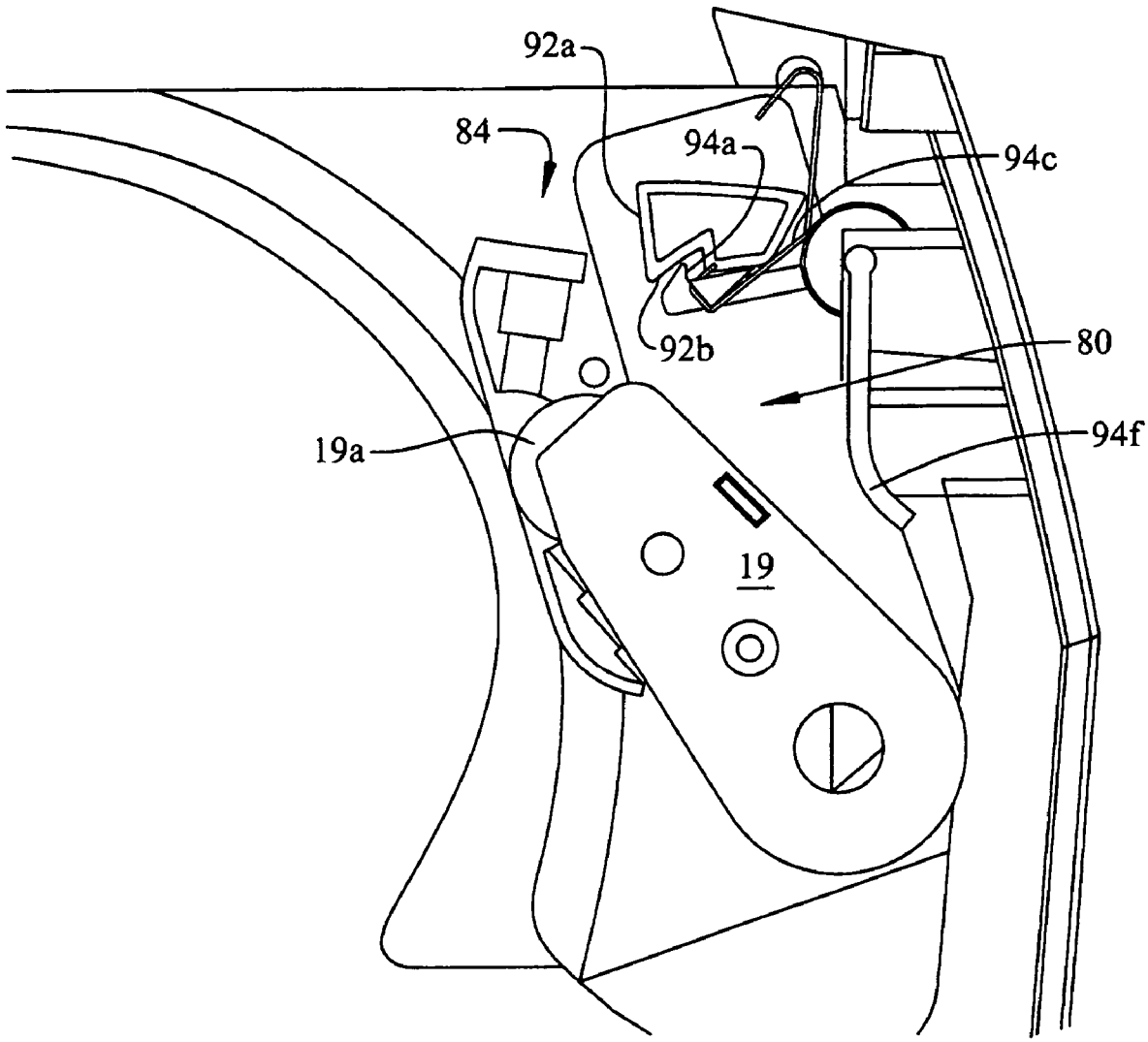
FIG. 10 is a side view with the media sensor in position for sensing.

A cycle of operation is conducted for the feeding of each sheet of media. This can be deemed to start at any point, as it is repetitive. FIG. 10 shows the mechanism with the sensor 80 in position to sense paper or other media (not shown). Although autocompensating system roller 19*a* is also positioned to be against the media, the sensing is done so quickly that no significant drive occurs before motor 30 is reversed to move autocompensating system 19 away from media in the feed path 17. Media sensor 80 has moved forward under the action of the slip connection drive through spring 108 because ledge 94*a* was rotated downward away from facing ledge 94*a* as discussed below.

Figure 11:
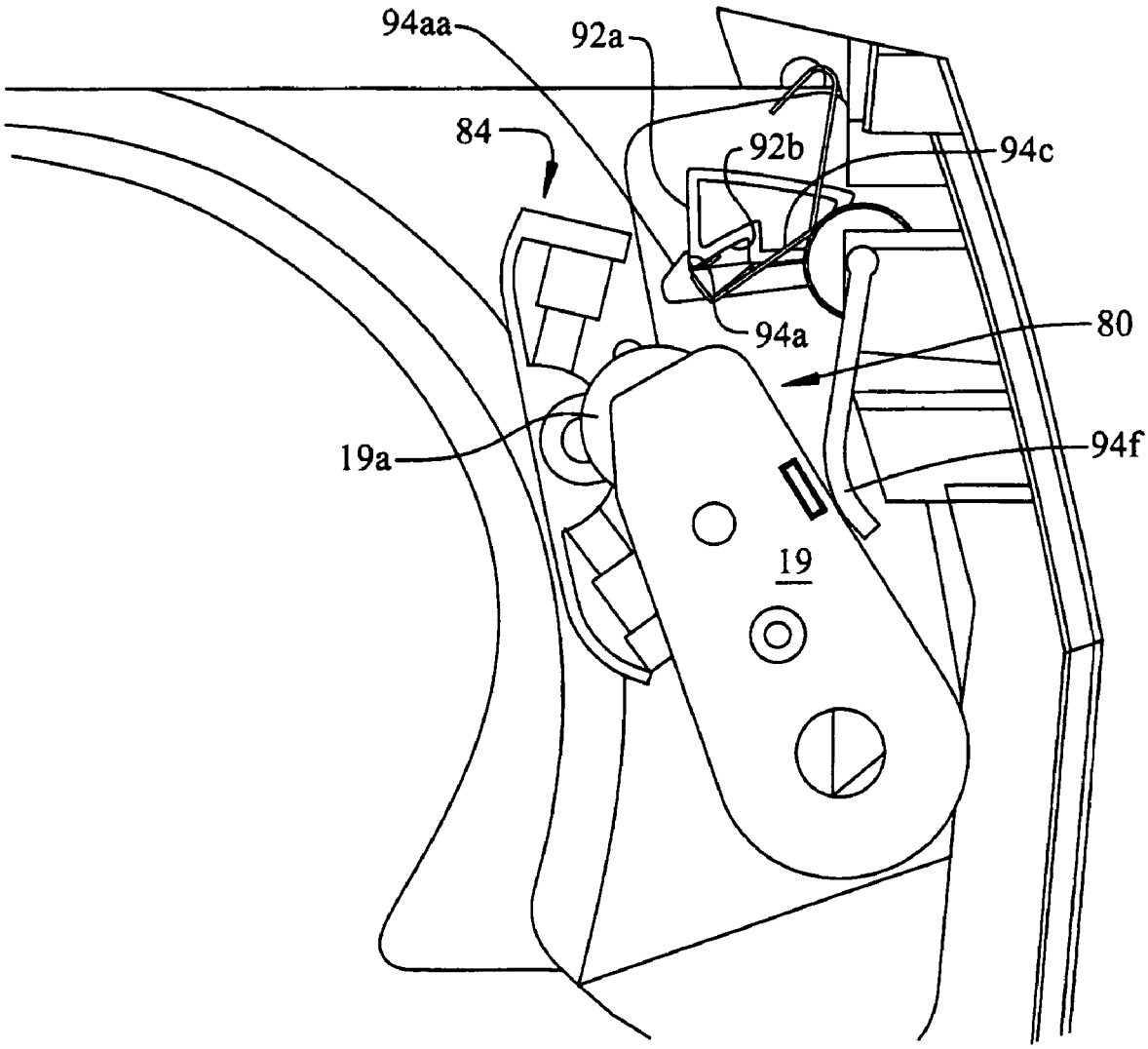
FIG. 11 is side view with the media sensor latched against rotation.

The reversed movement of autocompensating system 19 is a limited distance far enough to latch media sensor away from media in the paper path. The end location of that movement is shown in FIG. 11. Rotatable assembly 94 was rotated upward under the action of spring 94*c* as media sensor 80 rotated with the rotation of autocompensating system 19. Cam surfaces 94*aa* and 92*b* facilitate smooth movement. Media sensor 80 is then locked against forward movement by abutment surface 92*a* facing ledge 94*a*.

Figure 12:
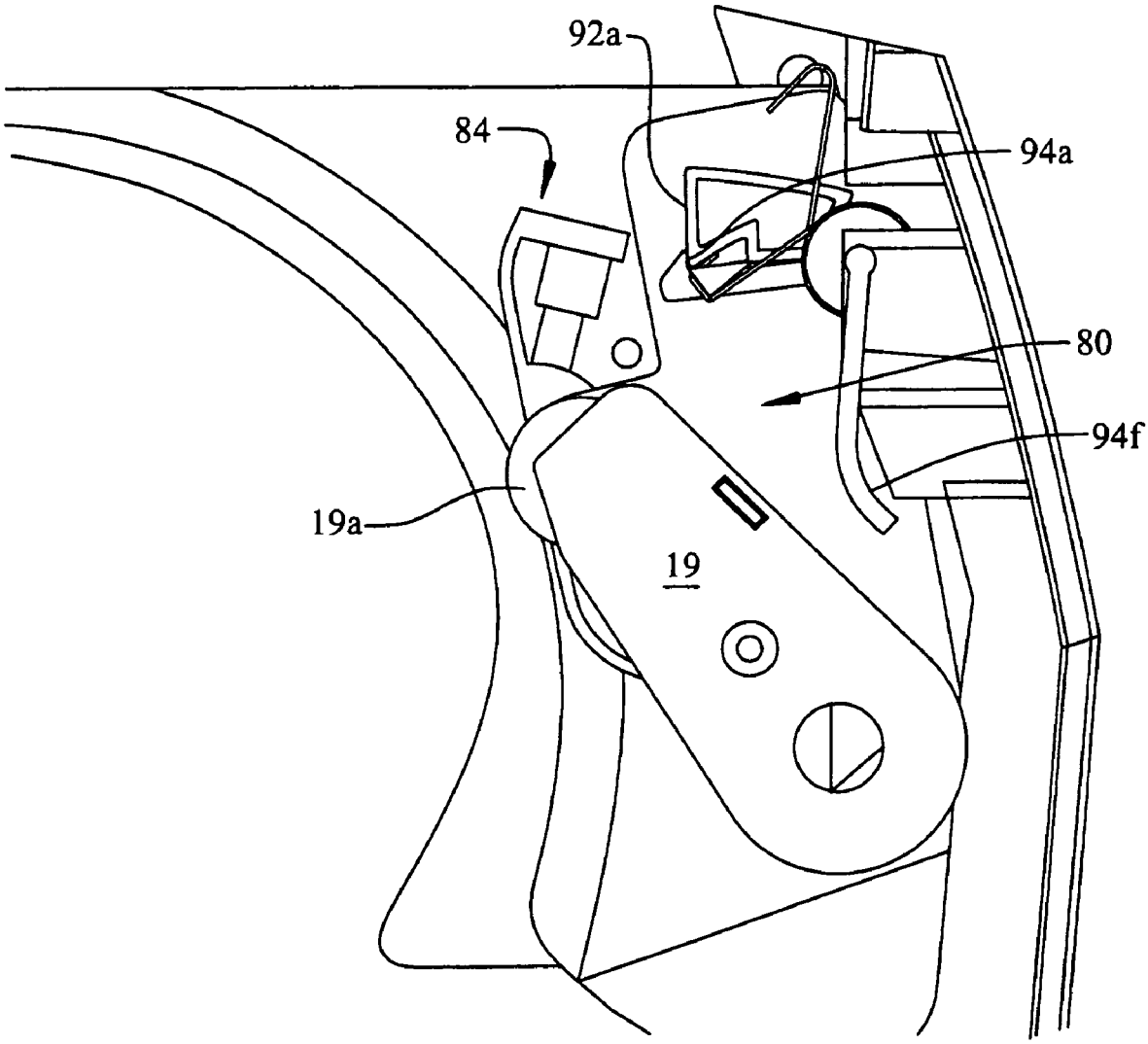
FIG. 12 is a side view with the autocompensating system in position to drive media.

Motor 30 is once again reversed to rotate autocompensating system 19 to the media in path 17 and to drive the media until it reaches nip rollers 9*a*, 9*c*, while media sensor 80 is held away from path 17. This position is shown in FIG. 12.

Figure 13:
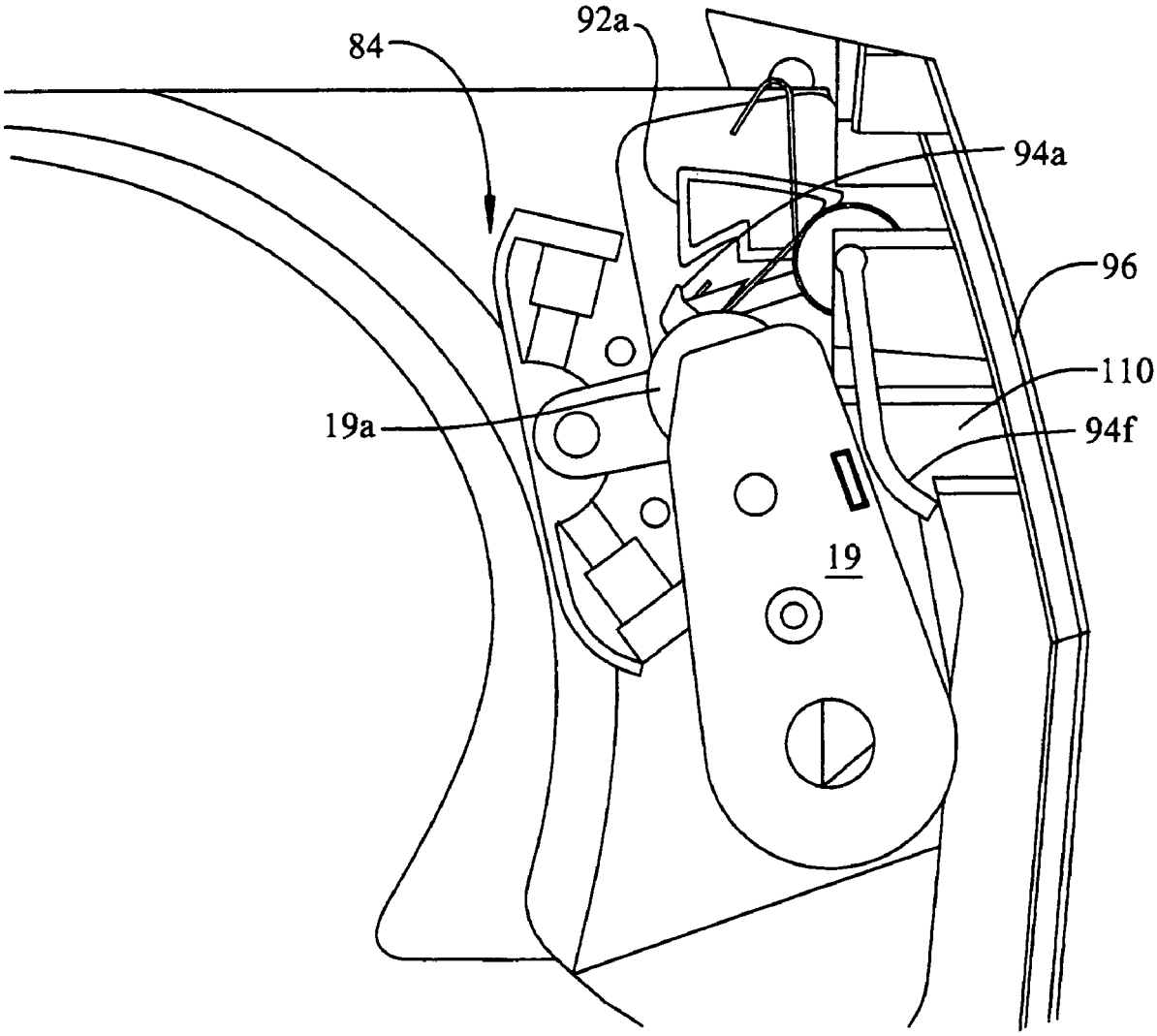
FIG. 13 is a side view with the autocompensating system moved fully back to free the media sensor for rotation.

As shown in FIG. 13 autocompensating system 19 is then moved by motor 30 a longer distance away from media path 17 than the previous movement away from media path 17. Media Sensor 80 does not move the full distance with autocompensating system 19 as such full movement is blocked by a post 110 extending from door 96. In this position autocompensating system 19 has encountered lever 94*f* and rotated it substantially while media sensor 80 does not rotate because of post 110. This rotation frees media sensor 80 for forward movement by moving ledge 94*a* away from abutment surface 92*a*.

When a subsequent sheet is fed, motor 30 rotates autocompensating system 19 to the position of FIG. 10. Media sensor 80 moves immediately with system 19 when system 19 moves, which is while lever 94*f* is still depressed enough to free media sensor 80 so abutment surface 92*a* moves past ledge 94*a* and no latching occurs. The cycle as just described is then repeated for the next media.

With respect to this invention, the autocompensating aspect of autocompensating system 19 is not significant, although the rotating aspect is employed. Mechanical variation of the foregoing will be apparent which permit the sensing element to be rotated in for sensing, to be rotated out to a latched position, and to the be unlatched by a larger outward rotation of a drive member. Although a single motor is generally all that is needed, one motor might be used for rotation in one direction and another motor used for rotation is another direction.

What is claimed is:

1. An imaging device comprising an imaging station, a sheet media tray spaced from said imaging station, a media guide path between said imaging station and said media tray, a pivotally mounted media feed system located for driving media through said media guide path, a pivotally mounted media sensor located for sensing media in said media guide path, said media sensor having an abutment surface, at least one motor to provide torque to said media feed system, a slip connection between said media feed system and said media sensor to provide torque to said media sensor, a blocking member located on said imaging device to block said media sensor to limit movement of said media sensor away from said media guide path, a rotatable member mounted on said imaging device having a ledge and an arm, and being resiliently biased to rotate said ledge to face said abutment surface of said media sensor for preventing pivoting of said media sensor, a lever being located to rotate said rotatable member by contact with said media feed system to move said ledge to not prevent pivoting of said media sensor when said media feed system pivots away from said media guide path a greater distance than said media sensor moves away from said media guide path, and wherein:

said media feed system moves by said motor and said media sensor moves by said slip connection to bring said media sensor to said media for said media sensor to sense said media, said media feed system moves by said motor away from said media guide path and said media sensor moves away from said media guide path by said slip connection a limited, first amount at which said ledge faces said abutment surface in response to rotation under said bias of said rotatable member, said media feed system moves by said motor to said media guide path while said media sensor is held by said abutment and ledge and said slip connection slips, and said media feed system moves away from said media guide path in an amount greater than said first amount to contact said lever to thereby rotate said rotatable member and free said media sensor to move under said slip connection for sensing media in said media feed path.

2. The imaging device of claim 1 in which said slip connection comprises a second member which is rotated by a shaft which rotates said media feed system and which is frictionally engaged with said media sensor under resilient bias.

3. The imaging device of claim 1 in which said media feed system is an autocompensating system.

4. The imaging device of claim 2 in which said media feed system is an autocompensating system.

* * * * *